US006405003B2

(12) United States Patent
Uehara

(10) Patent No.: US 6,405,003 B2
(45) Date of Patent: Jun. 11, 2002

(54) SEAL STRUCTURE PROVIDING AN IMPROVED SEALING FUNCTION AND REDUCING AN AMOUNT OF HEAT GENERATED BY FRICTION

(75) Inventor: Shinichi Uehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/824,770

(22) Filed: Apr. 4, 2001

(30) Foreign Application Priority Data

Apr. 5, 2000 (JP) ..... 2000-103520

(51) Int. Cl.[7] ..... G03G 15/08
(52) U.S. Cl. ..... 399/103; 399/105
(58) Field of Search ..... 399/102, 103, 399/104, 105, 106

(56) References Cited

U.S. PATENT DOCUMENTS 5,794,101 A * 8/1998 Watanabe et al. ..... 399/103
5,870,651 A * 2/1999 Shimada ..... 399/102
6,101,894 A * 8/2000 Sato et al. ..... 399/106

FOREIGN PATENT DOCUMENTS

JP 4-25875 A * 1/1992
JP 4-011556 1/1992
JP 8-036306 2/1996
JP 8-308164 A * 11/1996
JP 9-026743 1/1997
JP 11-184230 A * 7/1999

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A seal structure comprising a seal member for preventing toner from leaking out of a casing, the seal member adhesively provided and compressively deformed between an interior floor portion of the casing and a lower outer edge portion of a cylindrical member disposed so as to rotate freely above and parallel to the interior floor of the casing, the seal member being made of an elastic material and disposed so that a degree of compressive deformation of the seal member is greater toward a longitudinal center of the cylindrical body than at the outer edge of the cylindrical body.

12 Claims, 3 Drawing Sheets

SEAL STRUCTURE PROVIDING AN IMPROVED SEALING FUNCTION AND REDUCING AN AMOUNT OF HEAT GENERATED BY FRICTION

BACKGROUND OF THE INVENTION

1. Field of the Invention

The present invention relates to a seal structure for preventing powder or liquid contents of a casing from leaking from axial end portions of the casing, the casing containing a cylindrical member provided so as to be freely rotatable above and parallel to a bottom surface portion of the casing, and more particularly, to a seal structure that can be employed effectively with a development roller for a developing unit of an electronic photographic type image forming apparatus.

2. Description of the Related Art

A seal structure for preventing toner from leaking from the longer axial ends of a development roller that forms part of a developing unit in an electrophotographic image forming apparatus is disclosed in Japanese Laid-Open Patent Application No. 8-36306. FIG. 1 is a diagram showing a perspective view of a seal structure 51 provided at a front portion of a bottom part of a toner cartridge or casing 61 that also forms part of the developing unit 60, with FIG. 2 showing a frontal view thereof. It should be noted that although FIGS. 1 and 2 show only the left half of the developing unit 60, the right half has an identical corresponding structure.

To proceed with a description of the seal structure 51, the front portion of the bottom part of the toner casing 61 is openly disposed opposite a photosensitive drum not shown in the diagram, with a developing roller 52 provided at the open part. A toner supply roller not shown in the diagram is provided at the back of the developing roller 52 and in contact with the developing roller 52. The photosensitive drum would be positioned at the front of the developing roller 52 shown in FIG. 2, that is, between the observer and the sheet of paper on which the diagram is printed.

In the development process according to the developing unit 60, the toner inside the toner casing 61 is supplied to the photosensitive drum via the toner supply roller and the developing roller 52. In this case, a rotation of the developing roller 52 in a direction indicated by the arrow B in FIGS. 1 and 2 supplies the toner at the bottom portion of the interior of the toner casing 61 to the photosensitive drum, with any toner that did not contribute to the development of the image being scraped from the drum by a recovery blade not shown in the diagram and returned to the interior of the toner casing 61.

The seal structure 51 described above prevents toner T remaining in the space between the bottom of the developing roller 52 and the floor of the toner casing 62 from leaking into a space 55 on an outer side of an outer edge surface 52*a* of the developing roller 52.

According to the above-described seal structure 51, by using an adhesive and adhering a sheet-like seal member 53 to a toner casing floor portion 63 disposed opposite a lower outer edge of the developing roller 52, the lower outer edge of the developing roller 52 and the corresponding floor portion 63 compressively deform the seal member 53. In other words, the floor portion 63 becomes an adhesive surface for the seal member 53. However, in the course of the developing process the outer edge of the developing roller 52 is compressed as it rotates by the seal member 53, unavoidably generating a certain amount of heat.

In the above-described seal structure 51, the outer edge of the developing roller 52 is parallel to the casing floor 62 and the seal member 53 is of uniform thickness as it is adhered to the adhesive surface 63, so the seal function is effected by uniformly compressively deforming the seal member 53. Such an arrangement poses a number of disadvantages. For example, if the seal pressure is low (that is, if the amount by which the seal member 53 is deformed is small), then the toner T can leak out into the space 55 via the contact between the outer edge of the developing roller 52 and the seal member 53. Additionally, if the seal pressure is increased to counteract the above-described possibility and to more securely prevent leakage of the toner, then there is the disadvantage of an increase in the amount of frictional heat generated at the point at which the outer edge of the developing roller 52 and the seal member 53 contact each other. In extreme cases, the toner itself is melted by the heat so generated. Although to some extent it is possible to reduce the amount of heat generated by friction by making the surface of the seal member smoother and more slippery so as to reduce friction, there is a limit to what such countermeasures can achieve.

SUMMARY OF THE INVENTION

It is a general object of the present invention to provide an improved and useful seal structure in which the above-described disadvantages are eliminated.

A more specific object of the present invention is to provide an improved and useful seal structure in which the contents of the casing (whether in powder or liquid form) are prevented from leaking outside thereof.

Another and more specific object of the present invention is to provide an improved and useful seal structure in which a rise in temperature due to heat caused by friction between the cylindrical member and the seal member can be reduced.

The above-described objects of the present invention are achieved by a seal structure comprising a seal member for preventing toner from leaking out of a casing, the seal member adhesively provided and compressively deformed between an interior floor portion of the casing and a lower outer edge portion of a cylindrical member disposed so as to rotate freely above and parallel to the interior floor of the casing, the seal member being made of an elastic material and disposed so that a degree of compressive deformation of the seal member is greater toward a longitudinal center of the cylindrical body in an axial direction thereof than at the outer edge of the cylindrical body.

According to the above-described aspect of the invention, the sealing function of the seal structure is greatly improved over the conventional art and leakage of the toner from the axial ends of the casing can be securely prevented. Additionally, the amount of heated generated by friction between the seal member and the static parts of the unit is reduced, thus preventing the toner from melting.

The above-described objects of the present invention are also achieved by the seal structure as described above, wherein the seal member is a sheet of uniform thickness and a portion of the interior floor of the casing to which the seal member is adhered is higher toward the longitudinal center of the cylindrical member than toward the edge of the cylindrical member.

According to the above-described aspect of the invention, the seal structure can be produced simply and inexpensively because the seal member can continue to be made of a single strip of uniform thickness while the slant of the adhesive surface allows differential pressure to be applied to different part of the seal member so as to provide a better seal.

Other objects, features and advantages of the present invention will become more apparent from the following detailed description when read in conjunction with the accompanying drawings.

DETAILED DESCRIPTION OF THE PREFERRED EMBODIMENTS

A description will now be given of embodiments of the present invention, with reference to the accompanying drawings. It should be noted that identical or corresponding elements in the embodiments are given identical or corresponding reference numbers in all drawings, with detailed descriptions of such elements given once and thereafter omitted.

Figure 3:
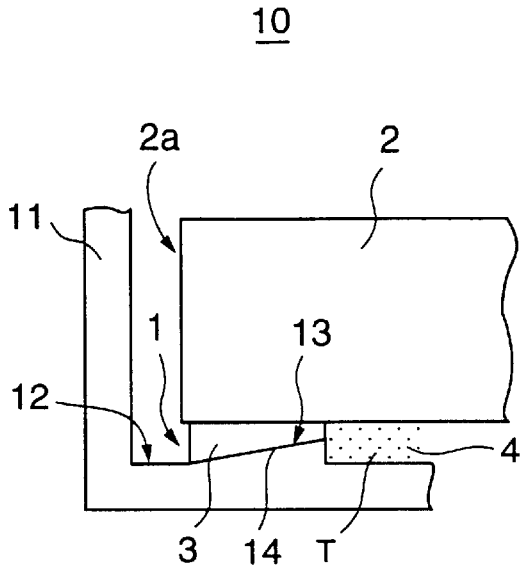
FIG. 3 is a schematic frontal view of a seal structure according to a first embodiment of the present invention.

FIG. 3 is a schematic frontal view of a seal structure according to a first embodiment of the present invention.

The seal structure 1 shown in FIG. 3 is provided on a developing unit 10 of an electrophotographic image forming apparatus for the purpose of preventing toner inside the toner cartridge (casing) from leaking out the axial ends of the developing roller 2.

The above-described seal structure 1 has the following composition. A seal member 3 is adhered using an adhesive 14 to a portion 13 of the casing floor 12 disposed opposite the outer edge of the developing roller 2 (such floor portion for adhering the seal member 3 hereinafter referred to as the adhesive surface 13). The adhesive surface 13 is a single flat (that is, not curved) slanted surface, slanted so that a side toward an interior in a direction of an axis of the developing roller 2 (a side in which the toner T is stored) is higher than a side toward an edge 2*a* of the roller. Additionally, the seal member 3 is made of an elastic material such as plastic or rubber, and is a sheet-like strip of uniform thickness. In FIG. 3, the seal member 3 is shown pressed against the adhesive surface 13 and compressively deformed by the outer edge of the developing roller 2, in other words, FIG. 3 shows a state in which the toner T inside the toner containment space 4 is prevented from leaking out the axial edges of the developing roller 2, and in this state the developing roller 2 is rotated so as to carry out development of an image.

It is preferable that the material from which the seal member 3 is made be either a plastic that is elastic, mechanically strong and durable against friction or a mechanically strong, abrasion-resistant rubber. Additionally, it is desirable that the portion of the surface of the seal member 3 that contacts the edge of the developing roller 2 be coated with lubricating polyinylidene fluoride (PVDF) particles.

As can be seen from FIG. 3, the structure of the above-described seal structure is such that a distance or separation between the surface of the outer edge of the developing roller 2 and the adhesive surface 13 is smaller toward the center of the developing roller 2 in an axial direction thereof than at the outer edge of the developing roller 2*a*. For this reason, the amount by which the seal member 3 is compressively deformed, and therefore the seal pressure, is greater toward the interior in the axial direction than toward the edge of the developing roller 2.

Figure 1:
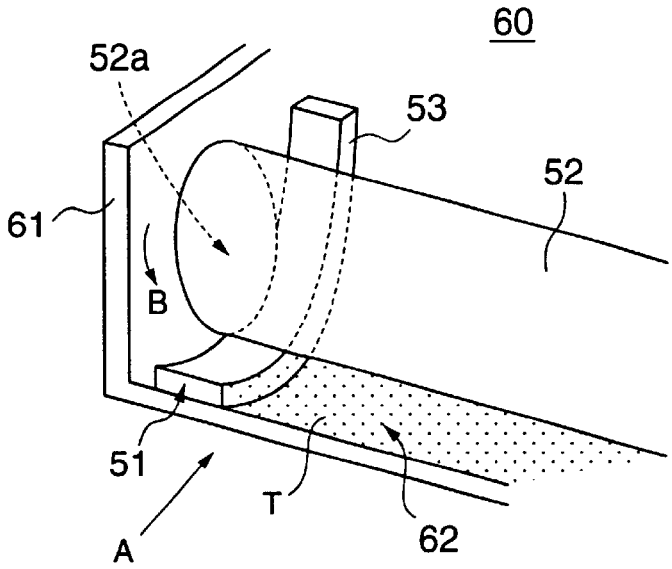
FIG. 1 PRIOR ART
FIG. 1 is a schematic perspective view of a conventional seal structure.
Figure 2:
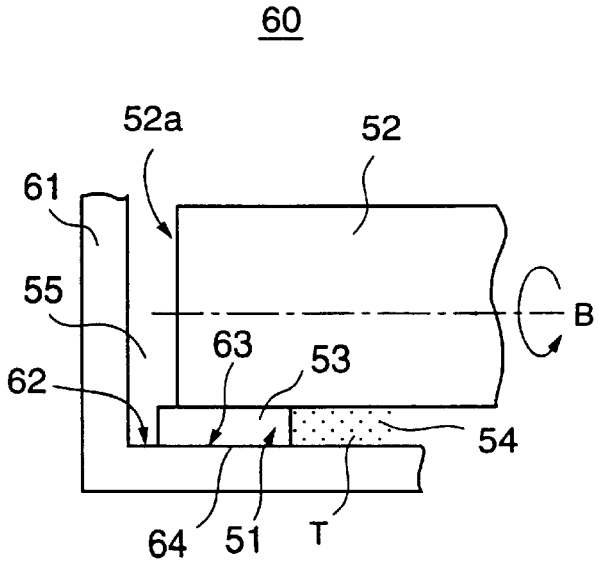
FIG. 2 PRIOR ART
FIG. 2 is a frontal view of the conventional seal structure shown in FIG. 1 along a line shown by arrow A in FIG. 1.

As a result, in addition to obtaining a fully adequate seal at the interior portion of the seal member 3, the amount of frictional heat generated at the point of contact between the developing roller 2 and the seal member 3 is reduced as compared to the conventional arrangement shown in FIG. 2. Moreover, the surface area of the adhesive surface 13 is larger than the corresponding adhesive surface 63 according to the conventional arrangement (see FIG. 2) and so the surface area across which the frictional heat is dissipated is increased, thus providing a more efficient mechanism by which to prevent a rise in temperature due to friction.

A description will now be given of a seal structure according to a second embodiment of the present invention.

Figure 4:
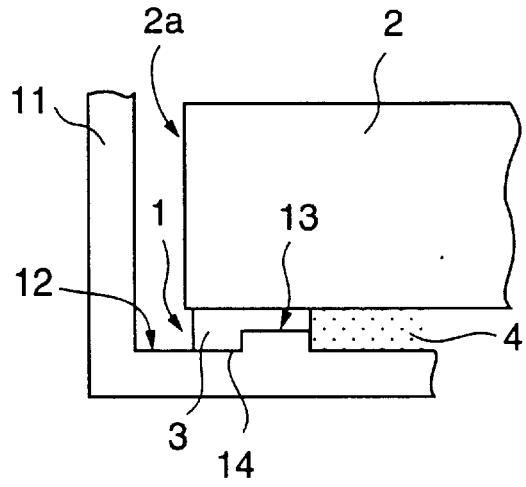
FIG. 4 is a schematic frontal view of a seal structure according to a second embodiment of the present invention.

FIG. 4 is a schematic frontal view of a seal structure according to a second embodiment of the present invention.

As shown in the diagram, in the seal structure 1 shown in FIG. 4 the adhesive surface 13 is stepped so that a side closer to the interior of the and the developer roller 2 in the axial direction is higher than a side at the edge of the developer roller 2*a*. In this case, too, the seal member 3 is a sheet-like strip of uniform thickness, adhered to the adhesive surface 13 by an adhesive 14. The rest of the structure is essentially the same as that of the first embodiment. It should be noted that although the surface that connects the two stepped portions of the adhesive surface is shown in FIG. 4 as being perpendicular to the surface of the casing floor 12, in actuality this connecting surface may also be slanted (either in a straight line or curved) toward the interior of the developing roller 2 in an axial direction thereof.

According to the seal structure of the second embodiment as described above, the seal function and heat-reducing function afforded by the stepped adhesive surface 13 are improved over those provided by the first embodiment.

A description will now be given of a seal structure according to a third embodiment of the present invention.

Figure 5:
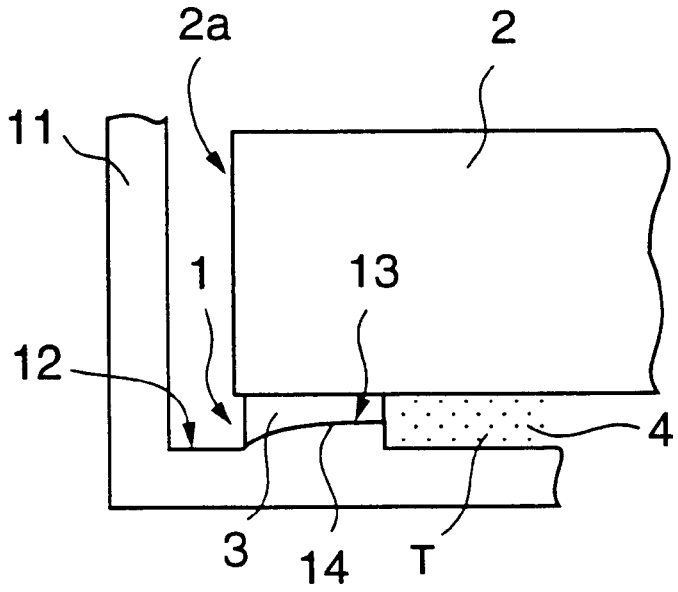
FIG. 5 is a schematic frontal view of a seal structure according to a third embodiment of the present invention.

FIG. 5 is a schematic frontal view of a seal structure according to a third embodiment of the present invention.

As shown in the diagram, the seal structure 1 of FIG. 5 has a curved adhesive surface 13, with the higher end toward the interior of the developing roller 2 in an axial direction thereof. In this case, too, the seal member 3 is a sheet-like strip of uniform thickness. The rest of the structure is essentially the same as that of the first embodiment.

According to the seal structure of the third embodiment as described above, in addition to providing the same effects as those of the first embodiment, the tapered surface of the adhesive surface 13 allows the seal pressure to be continuously reduced toward the outer edge of the developer roller, with a consequent reduction in the amount of heat generated by friction.

It will be appreciated by those of skill in the art that the above-described seal structure according to the present invention is not limited to use with an electrophotographic imaging unit but may be effectively adapted to any imaging unit component such as a developing unit, photosensitive unit or cleaning unit of a copier, printer, facsimile machine or the like that uses a toner or toner component to form images.

The present invention is not limited to the specifically disclosed embodiment, but variations and modifications can be made without departing from the scope and spirit of the present invention.

The present invention is based on Japanese priority application No. 2000-103520 filed on Apr. 5, 2000, the entire contents of which are hereby incorporated by reference.

What is claimed is:

1. A seal structure comprising a seal member for preventing toner from leaking out of a casing, the seal member adhesively provided and compressively deformed between an interior floor portion of the casing and a lower outer edge portion of a cylindrical member disposed so as to rotate freely above and parallel to the interior floor of the casing, the seal member being made of an elastic material and disposed so that a degree of compressive deformation of the seal member is greater toward a longitudinal center of the cylindrical body than at the outer edge of the cylindrical body.

2. The seal structure as claimed in claim 1, wherein the seal member is a sheet of uniform thickness and a portion of the interior floor of the casing to which the seal member is adhered is higher toward the longitudinal center of the cylindrical member than toward the edge of the cylindrical member.

3. The seal structure as claimed in claim 2, wherein the portion of the interior floor of the casing to which the seal member is adhered is a single flat slanted surface.

4. The seal structure as claimed in claim 2, wherein the portion of the interior floor of the casing to which the seal member is adhered is a stepped surface.

5. The seal structure as claimed in claim 4, wherein a surface that connects stepped portions of the interior floor of the casing to which the seal member is adhered is perpendicular to the surface of the casing floor.

6. The seal structure as claimed in claim 4, wherein a surface that connects stepped portions of the interior floor of the casing to which the seal member is adhered is at an angle to the surface of the casing floor.

7. The seal member as claimed in claim 2, wherein the portion of the interior floor of the casing to which the seal member is adhered is a single curved slanted surface.

8. The seal member as claimed in claim 1, wherein:

the cylindrical member is a developing roller that forms part of a developing unit provided on an electrophotographic image forming apparatus;

the casing is a toner cartridge; and the seal structure prevents leakage of the toner inside the toner cartridge from axial end portions of the developing roller.

9. The seal structure as claimed in claim 1, wherein the cylindrical member is a photosensitive drum that forms part of a photosensitive unit provided on an electrophotographic image forming apparatus;

the casing encloses the photosensitive drum; and the seal structure prevents leakage of the toner inside the casing from axial end portions of the photosensitive drum.

10. The seal structure as claimed in claim 1, wherein, the cylindrical member is a magnetic roller cleaner that forms part of a cleaning unit provided on an electrophotographic image forming apparatus;

the casing encloses the magnetic roller cleaner; and the seal structure prevents leakage of the toner inside the toner cartridge from axial end portions of the magnetic roller cleaner.

11. The seal structure as claimed in claim 1, wherein the seal member is made of a plastic material.

12. The seal structure as claimed in claim 1, wherein the seal member is made of a rubber material.

* * * * *